US005163397A

United States Patent [19]

Pien

[11] Patent Number: 5,163,397

[45] Date of Patent: Nov. 17, 1992

[54] HOT PILOT FUEL IGNITED INTERNAL COMBUSTION ENGINE AND METHOD OF OPERATING SAME

[76] Inventor: Pao C. Pien, 1105 Marbelle Club 840 S. Collier Blvd., Marco Island, Fla. 33937

[21] Appl. No.: 813,828

[22] Filed: Dec. 27, 1991

Related U.S. Application Data

[63] Continuation-in-part of Ser. No. 696,705, May 7, 1991, abandoned.

[51] Int. Cl.[5] ..... F02D 19/08; F02B 3/00

[52] U.S. Cl. ..... 123/299; 123/304; 123/575

[58] Field of Search ..... 123/299, 304, 575, 576, 123/577, 578, 300, 445, 446, 447, 450, 448; 239/5, 90, 91, 88

[56] References Cited

U.S. PATENT DOCUMENTS

| | | | |
|---|---|---|---|
| 2,319,858 | 5/1943 | Grow | 123/304 |
| 2,440,196 | 4/1948 | Fenney | 103/7 |
| 2,741,230 | 4/1956 | Reynolds | 123/304 |
| 2,968,298 | 1/1961 | Meurer | 123/139 |
| 3,737,100 | 6/1973 | Dreisin | 239/89 |
| 3,749,097 | 7/1973 | Grow | 123/304 |
| 4,527,737 | 7/1985 | Deckard | 239/89 |
| 4,531,672 | 7/1985 | Smith | 239/89 |
| 4,554,903 | 11/1985 | Straubel et al. | 123/575 |
| 4,700,672 | 10/1987 | Baguora | 123/299 |
| 4,736,712 | 4/1988 | Savkar et al. | 123/304 |
| 4,864,990 | 9/1989 | Tateishi et al. | 123/304 |
| 5,024,195 | 6/1991 | Pien | 123/304 |
| 5,029,568 | 7/1991 | Perr | 123/447 |

FOREIGN PATENT DOCUMENTS

| | | | |
|---|---|---|---|
| 307808 | 6/1973 | Austria | 123/299 |
| 875103 | 4/1953 | Fed. Rep. of Germany | 123/299 |
| 1062489 | 7/1953 | Fed. Rep. of Germany | 123/299 |
| 58-170848 | 10/1983 | Japan | 123/299 |
| 2136885 | 9/1984 | United Kingdom | 123/299 |

OTHER PUBLICATIONS

SAE Technical Paper Series 901564 (Sep. 1990), Development Status of the Detroit Diesel Corporation Methanol Engine.

*Primary Examiner*—Raymond A. Nelli
*Attorney, Agent, or Firm*—Roy W. Butrum

[57] ABSTRACT

The temperature of a small amount of pilot fuel is greatly increased prior to injection into a combustion chamber. In all forms, the injection nozzle has a heating space for heating pilot fuel and which is in communication with both a main fuel orifice and a pilot fuel orifice. The pilot fuel orifice is always open, while the main fuel orifice is periodically closed by a needle valve. In a modified form, the nozzle includes an extension which extends into the combustion chamber and has the heating space therein. The main fuel orifice and pilot fuel orifice are formed in the extension. When the needle valve is in closed position, it closes the main fuel orifice and also prevents communication between the heating space and the associated fuel injection pump.

29 Claims, 5 Drawing Sheets

Fig. 2.
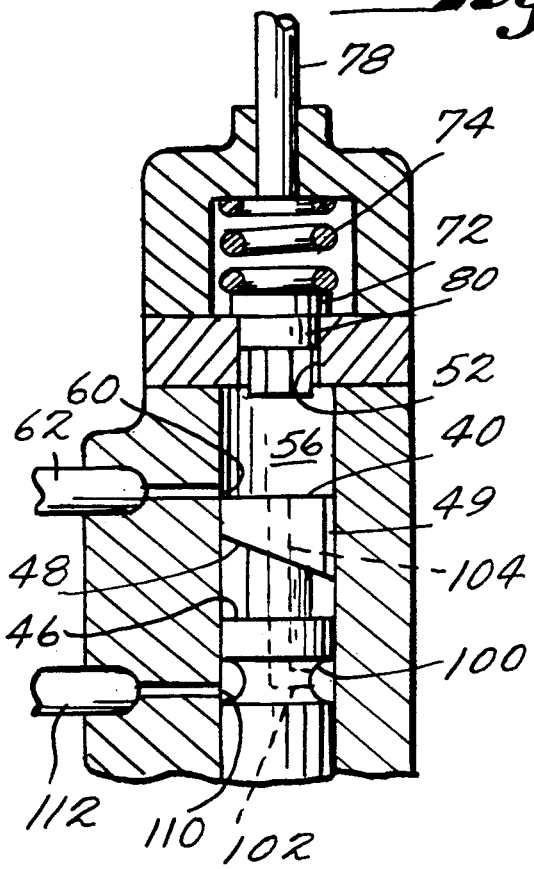
Fig. 5.
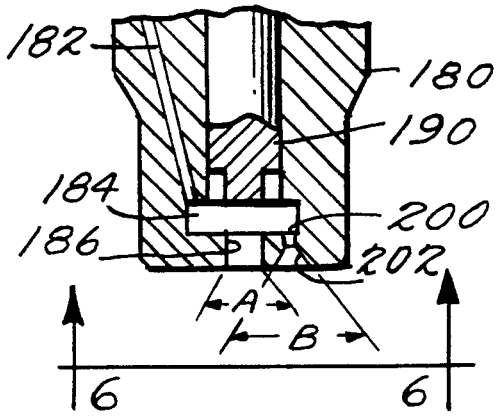
Fig. 3.
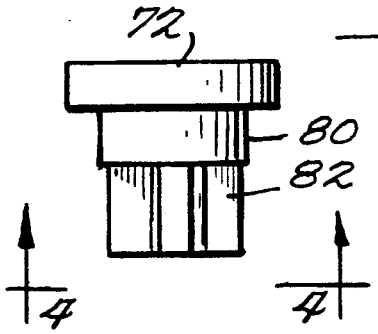
Fig. 6.
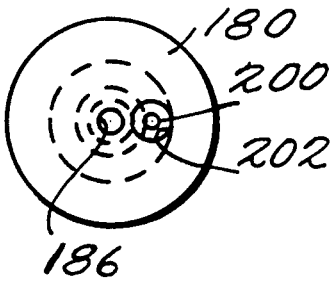
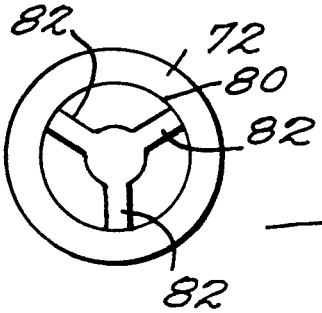
Fig. 4.

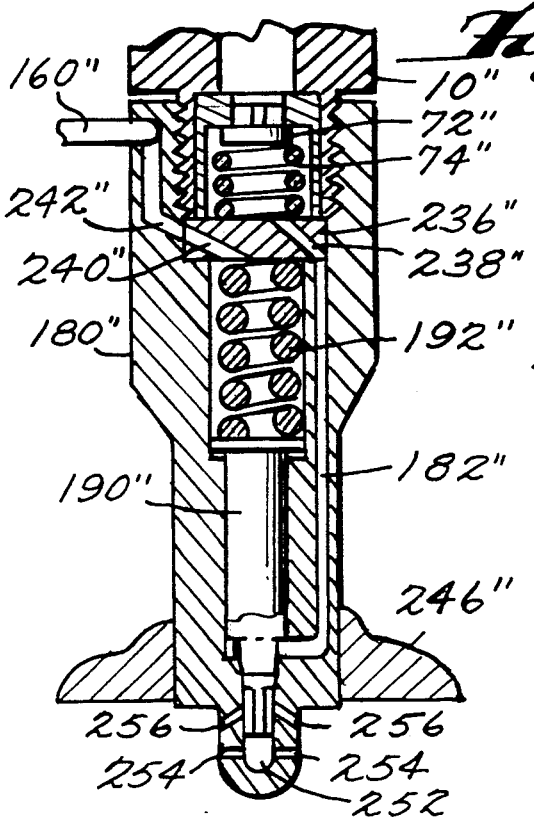
Fig. 9.
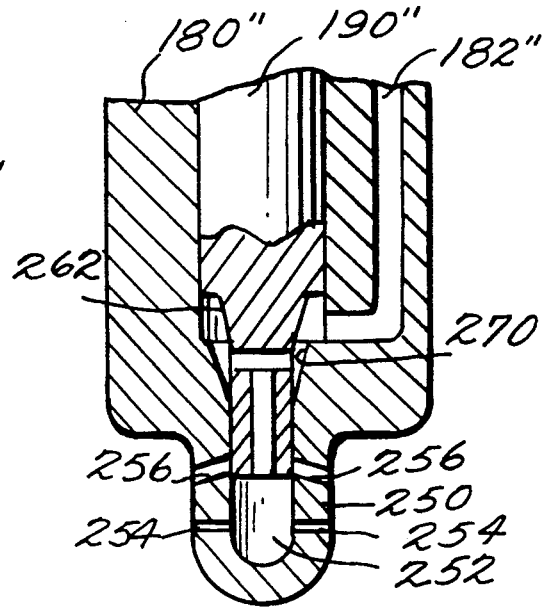
Fig. 13.
Fig. 10.
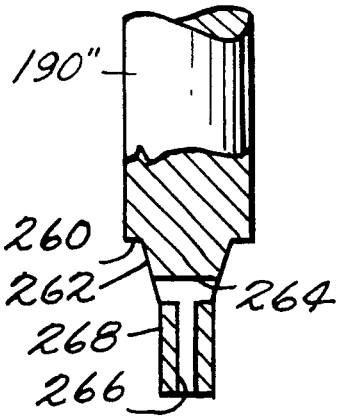
Fig. 11.
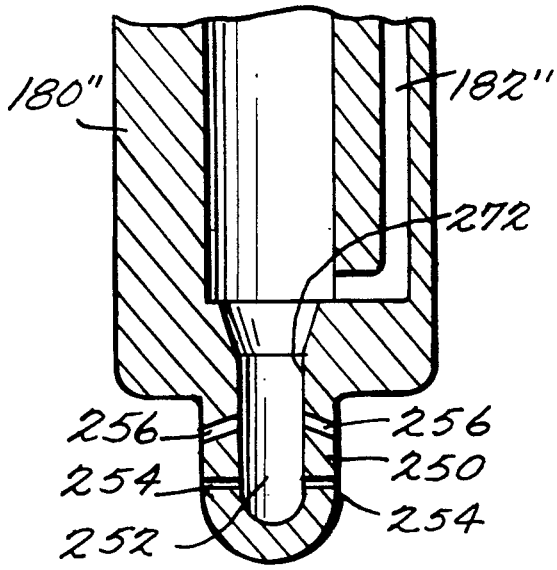
Fig. 12.
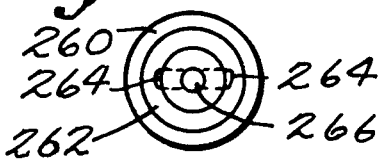

HOT PILOT FUEL IGNITED INTERNAL COMBUSTION ENGINE AND METHOD OF OPERATING SAME

CROSS-REFERENCE TO RELATED APPLICATION

The present application is a continuation-in-part of copending U.S. patent application Ser. No. 07/696,705, filed May 7, 1991, now abandoned.

BACKGROUND OF THE INVENTION

The present invention is related to and represents an improvement over the subject matter disclosed in applicant's U.S. Pat. No. 5,024,195. The disclosure of U.S. Pat. No. 5,024,195 is incorporated by reference into this application.

The present invention relates to multi-fuel compression-ignition internal combustion engines wherein liquid fuels of varying viscosity can be delivered to the engine under high pressure. A secondary fuel with high ignition qualities is used to start and warm up the engine When the engine has warmed up, a primary fuel is used to operate the engine. The invention is an improvement over the engine disclosed in the aforementioned patent in that the firing pressure can be effectively regulated by the rate of fuel injection.

There are two types of internal combustion engines based on the method of ignition thereof, namely spark-ignition engines and compression-ignition engines, the latter of which may also be designated as autoignition engines. A spark-ignition engine requires fuel with high volatility and high octane number. A compression-ignition engine requires fuel with a high cetane number and a certain amount of viscosity. The efficiency of a spark-ignition engine is limited by the allowable compression ratio which is determined by the octane number of the fuel used therewith. The specific engine output of a compression-ignition engine is limited by the peak firing pressure due to a high compression ratio required for producing the high compression air temperature necessary for compression ignition. Neither of these two types of engines can be designed for optimum specific engine output.

The ignition delay of a compression-ignition engine leads to a large fuel accumulation in the combustion chamber when the combustion process begins. As a result, the firing pressure in the combustion process cannot be controlled. The current method of operating a compression-ignition engine employs a high cetane fuel in conjunction with a high compression ratio. A high compression ratio without the elimination of the ignition delay creates a high firing pressure which is detrimental to the engine reliability and specific engine output. It is therefore highly desirable to provide an engine employing a new type of ignition which can greatly reduce the ignition delay so that the firing pressure can be regulated by the rate of fuel injection to obtain optimum specific engine output.

SUMMARY OF THE INVENTION

One of the objectives of the present invention is to eliminate the ignition delay by a new ignition method which depends not solely upon a high compression temperature but also upon a hot pilot fuel injection as explained hereinafter. When the ignition delay is eliminated and the main fuel injection occurs after the top dead center position, a firing pressure distribution during the combustion process is independent of the compression process, except for its initial value. When the compression and the combustion processes have been uncoupled, the main difficulty in designing an autoignition engine is overcome. A compression ratio can be chosen high enough to minimize the formation of CO and HC (hydrocarbon) emissions without overstressing the engine structure; and at the same time, a firing pressure distribution can be specified freely to obtain the best compromise among the engine weight, the engine efficiency, and the engine emission control by choosing an appropriate rate of main fuel injection.

After eliminating the ignition delay, another objective of the invention is to achieve an autoignition engine which is lighter, more efficient and has less undesirable engine emission than a gasoline engine.

The present invention employs a unique construction wherein the temperature of a small amount of pilot fuel is greatly increased prior to injection into the combustion chamber of the engine. When the pilot fuel temperature is greatly increased, the ignition delay of the pilot fuel itself is greatly shortened and autoignition will take place quickly so that firing pressure variation can be controlled by controlling the rate of the ensuing main fuel injection.

In one form of the invention, a novel fuel injection means is provided which utilizes the hot gas produced in the combustion chamber during the previous engine cycle to preheat a small amount of pilot fuel which is injected into the combustion chamber and which initiates ignition before the main fuel is injected. The pressure rise is then controlled by the rate of the main fuel injection. This type of engine is designated hereinafter as an HPF-ignition engine, where HPF stands for hot pilot fuel.

The HPF-ignition engine also employs an injection pump means for delivering both a primary fuel and a secondary fuel under high pressure to the fuel injection means. In this form of the invention, the injection pump means is similar to that disclosed in applicant's aforementioned patent, with suitable modification thereof to cause hot gas to be withdrawn from the combustion chamber into a heating space in the associated fuel injection means.

The fuel injection means of this form of the invention includes a nozzle having a main fuel orifice means similar to that of conventional injector nozzles. In addition, the nozzle has a pilot fuel orifice means Both orifice means are in communication with a heating space within the nozzle where fuel and hot gas from the combustion chamber may mix together to heat the fuel The pilot fuel orifice means is always open, whereas the main fuel orifice means is periodically closed by a needle valve The pilot fuel orifice means enables hot gas from the combustion space to enter into the heating space within the injector nozzle during different portions of the operating cycle of the engine as hereinafter fully described.

Hot gas is available to preheat the pilot fuel only after the engine has been started. For easy starting, particularly in cold weather, the dual fuel injection pump delivers a secondary fuel having very high ignition qualities to the injector nozzle during initial start up of the engine. After the engine has started up, hot gas for preheating the pilot fuel is available and a primary fuel with no specific fuel requirement is delivered by the dual fuel injection pump to the injector nozzle. The secondary fuel is only required for a small amount of time during initial engine start up. The secondary fuel tank can be much smaller than the primary fuel tank, and since only a small amount of secondary fuel is used, it can be produced to meet the required properties without much concern for its cost.

In another form of the invention, the injection pump means and the fuel injection means are combined into a unitary structure including first and second body portions which are provided with cooperating screw threads thereon so that they can be assembled in operative position.

In a further form of the invention, the fuel injection means includes an extension means which extends into the associated combustion chamber. This extension means has a heating space therein which is in communication with a main fuel orifice means and a pilot fuel orifice means formed in the extension means. The pilot fuel orifice means is always open, whereas the main fuel orifice means is periodically closed by a needle valve. When the needle valve is in closed position, it also prevents communication between the heating space and the fuel injection pump means. During operation of this form of the invention, at the end of fuel injection, a quantity of fuel is retained in the heating space and is heated by conduction of heat from the combustion chamber through the extension means to the retained fuel. This heated quantity of fuel provides the hot pilot fuel which is sprayed into the combustion chamber during the following combustion process of the next cycle of operation of the engine.

When an injection pump means is employed such as disclosed in the aforesaid patent, the secondary fuel is retained in an annular groove to prevent leakage of the primary fuel, the secondary fuel being replenished every time the engine is started. The secondary fuel can be packaged and supplied in the same manner as conventional lubrication oil.

An existing diesel engine can be converted to an HPF-ignition engine by replacing its fuel system with the fuel system of the invention. Such a converted engine can operate on a large variety of fuels. An HPF-ignition engine can be built with a lighter engine weight and higher engine efficiency than a comparable spark-ignition gasoline engine because its pressure variation in the combustion process can be chosen as the best compromise between engine weight and engine efficiency. An automobile having an HPF-ignition engine can stop at any fuel station to pump the cheapest available clean fuel into the same fuel tank as long as there is no chemical reaction between various fuels Such an engine would greatly simplify fuel supply problems if used by military forces.

An HPF-ignition engine has no specific primary fuel requirement and thereby the auto industry can be independent from the petroleum industry. Each industry will be free to produce its best products. The auto industry can build light and efficient engines to operate on a large variety of fuels. The petroleum industry can produce cheap and clean straight run petroleum products without harmful additives or cracking processes. The fact that no cracking process is necessary will result in a great saving in equipment, labor and waste involved in a cracking process.

In the case of a compression-ignition engine where the combustion delay period is large, the rate of pressure raise when ignition occurs is determined by the amount of fuel accumulated during the delay period rather than the rate of fuel injection. In an HPF-ignition engine, the main fuel injection begins after the ignition. The rate of pressure rise is closely related to the rate of the main fuel injection. Hence the rate of pressure rise as well as the maximum pressure within the cylinder can be closely controlled by the rate of main fuel injection. As a result, engine noise and engine weight can be greatly reduced by an appropriate rate of fuel injection.

BRIEF DESCRIPTION OF THE DRAWINGS

FIG. 2 is a vertical cross-sectional view on an enlarged scale of a portion of the fuel injection pump shown in FIG. 1;

FIG. 3 is an enlarged view of the valve means shown in FIG. 2;

FIG. 4 is an end view of the valve means shown in FIG. 3 taken along line 4—4 of FIG. 3;

FIG. 5 is an enlarged cross-sectional view through the tip of the fuel injection nozzle shown in FIG. 1 with the needle valve lifted;

FIG. 6 is an end view of the tip of the nozzle shown in FIG. 5 taken along line 6—6 of FIG. 5;

FIG. 9 is a sectional view of the lower portion of a unitary fuel injector similar to that shown in FIG. 7 mounted in a cylinder head and employing a modified fuel injection nozzle;

FIG. 10 is an enlarged view, partly in section, of the needle valve shown in FIG. 9;

FIG. 11 is an bottom view of the lower end of the needle valve shown in FIG. 10;

FIG. 12 is an enlarged sectional view of the lower portion of the fuel injection nozzle shown in FIG. 9 with the needle valve removed for clarity;

FIG. 13 is an enlarged sectional view of the lower portion of the fuel injection nozzle shown in FIG. 9 showing the needle valve in a lifted position after initial movement thereof;

DESCRIPTION OF THE PREFERRED EMBODIMENT

Figure 1:
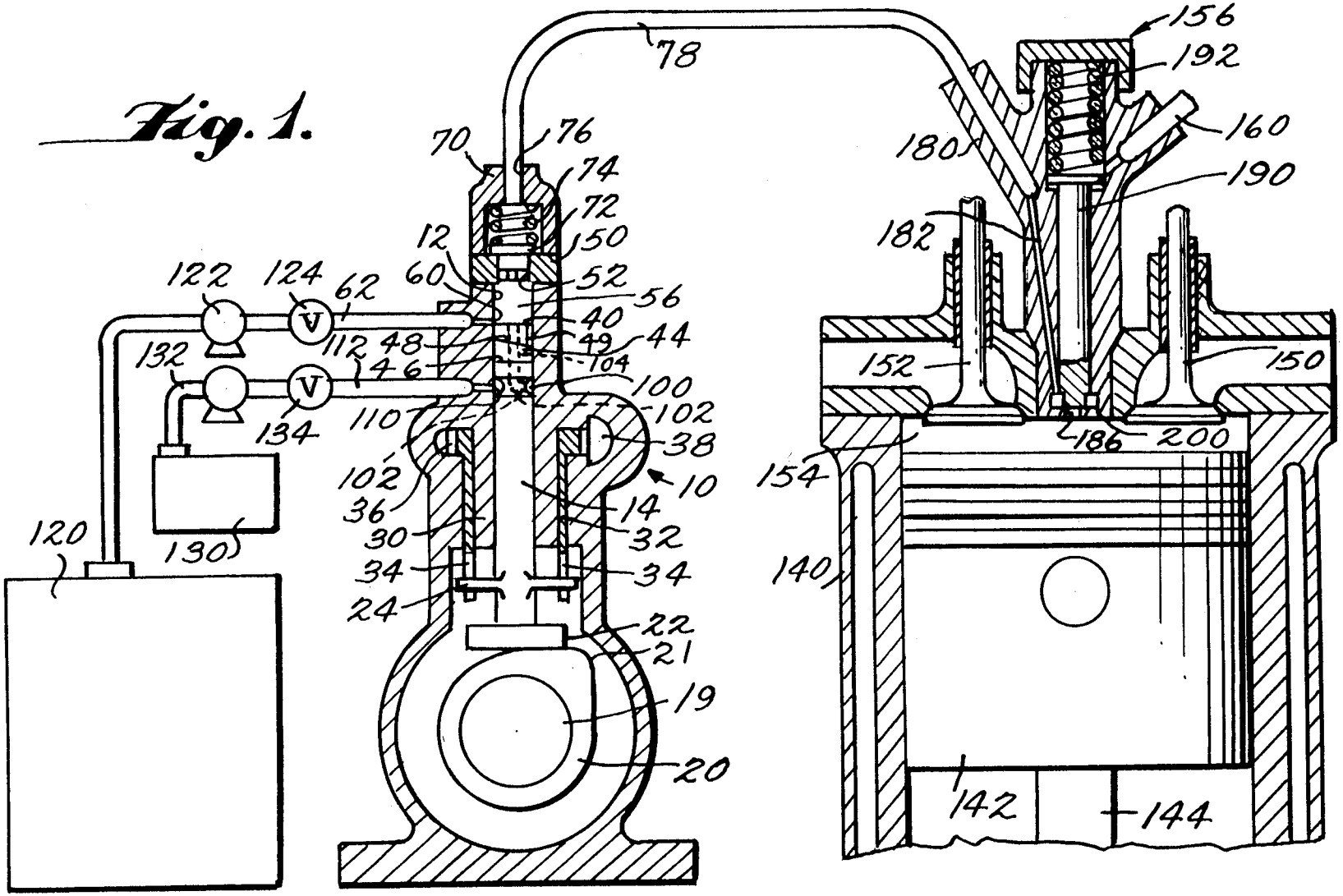
FIG. 1 is a somewhat schematic view, partly in section, illustrating portions of an HPF-ignition internal combustion engine according to the present invention.

Referring now to the drawings wherein like reference characters designate corresponding parts throughout the several views, there is shown in FIG. 1 a fuel injection pump according to the invention. A first body portion 10 has a bore 12 formed therein Elongated plunger means 14 is mounted for reciprocation and rotation within the bore. Cam means 20 is mounted on shaft 19 and rotates in synchronism with a cam shaft which operates the inlet and outlet valves associated with a cylinder of the engine in a well-known manner. This ensures that fuel will be fed at proper times under high pressure to a fuel injection means and thence into the combustion chamber of a cylinder.

Cam means 20 engages a follower portion 22 disposed at the bottom of the plunger means to cause reciprocation of the plunger means within the bore. A pair of integral arms 24 extend radially outwardly of the plunger means The first body portion includes a cylindrical portion 30, and a cylindrical sleeve 32 is mounted for rotation around portion 30. The sleeve has a pair of diametrically opposite slots 34 which extend parallel with the longitudinal axis of the plunger means. Arms 24 on the plunger means are snugly received within the slots so that the plunger means can freely reciprocate with respect to the sleeve, but is constrained to rotate therewith.

Circumferentially extending gear teeth 36 are provided at the upper end of the sleeve, and these gear teeth mesh with a rack member 38 so that longitudinal movement of the rack into or out of the plane of the paper will cause rotation of the sleeve. Rack member 38 may be operated in a known manner so as to vary the effective stroke of the plunger means of the pump.

The plunger means includes an upper end surface 40; and a helical groove 44, formed around the outer periphery of the plunger means, is spaced from the end surface. This helical groove is defined between a lower edge 46 which extends substantially circumferentially around the plunger means and an upper edge 48 which defines a portion of a helix. A longitudinally extending groove 49 provides communication between the helical groove and the end surface 40.

The upper end of the bore 12 in the first body portion is closed off by an end wall 50 having an outlet port mean 52 formed therethrough. A chamber 56 is defined within the bore in the first body portion and between the end wall 50 and the upper end surface 40 of the plunger means. An inlet port means 60 in the first body portion is adapted to be in communication with chamber 56 and is connected to a conduit 62.

FIG. 1 illustrates the plunger means in its lower limit of travel wherein inlet port means 60 is in communication with chamber 56. When cam means 20 rotates so that the lobe 21 formed thereon engages follower 22, plunger means 14 initially moves upwardly to shut off communication between inlet port means 60 and chamber 56. As the plunger means moves further upwardly, the pressure of the fuel within chamber 56 builds up. It is noted that fluid from the chamber can pass through groove 49 into helical groove 44.

When helical groove 44 comes into communication with inlet port means 60 as the plunger means moves upwardly, the fuel under high pressure within the helical groove can pass back through inlet port means 60 and into conduit 62. A suitable by-pass valve (not shown) may be connected in the conduit 62 to allow the fuel flowing back into the conduit from the helical groove to return to a source of fuel connected to the conduit.

It is apparent that by operating rack member 38 so as to rotate sleeve 32, the plunger means may be rotated within bore 12 while the plunger means is reciprocating in response to rotation of the cam means 20. As the plunger means rotates, different portions of the upper edge of the helical groove will be aligned with the inlet port means 60, so that the plunger means will move different distances in an axial direction before the helical groove comes into communication with the inlet port means, thereby varying the effective stroke of the plunger means. It is apparent that once the helical groove is in communication with the inlet port means, the fuel within chamber 56 can then flow back into conduit 62.

A small housing 70 is mounted on end wall 50 and houses a one-way check valve means including a valve member 72 for closing off the outlet means 52. The valve member is biased into closed position by a coil spring 74. The outlet means is normally closed off by the valve means under the influence of the coil spring. When the plunger means moves upwardly, the high pressure generated within chamber 56 causes the valve member to move upwardly against the force of the spring, and high pressure fuel flows past the valve member and through an outlet opening 76 in housing 70 into a fuel line 78 which leads to the fuel injection means of a cylinder of the engine as hereinafter described.

The plunger means has an annular groove or recess 100 extending therearound. Passage means formed within the plunger provides communication between the annular groove and the chamber 56, and includes a radial portion 102 which joins with a longitudinal portion 104. The passage means includes opposite ends, the outer end of radial portion 102 opening into the annular groove, and the upper end of longitudinal portion 104 opening into chamber 56 at the upper end surface 40 of the plunger means. The first body portion is provided with a second inlet port means 110 which is in communication with conduit 112.

Conduit 62 is connected with a source of primary fuel such as alcohol in the form of a conventional fuel tank 120. A conventional low pressure fuel pump 122 is connected in conduit 62 for pumping fuel from the primary fuel tank into the high pressure fuel injection pump. A control valve 124 is connected in conduit 62 for controlling the flow of primary fuel to the fuel injection pump.

Conduit 112 is connected with a source of secondary fuel such as diesel fuel in the form of a conventional fuel tank 130 which has a much smaller capacity than tank 120. A conventional low pressure fuel pump 132 is connected in conduit 112 for pumping fuel from the secondary fuel tank into the high pressure fuel injection pump. A control valve 134 is connected in conduit 112 for controlling the flow of secondary fuel to the fuel injection pump.

It will be noted that the annular groove 100 and the cooperating inlet port 110 form an additional secondary fuel pump on the same plunger and within the same bore as the primary fuel pump. This additional pump serves several important functions. Firstly, it can deliver only a high cetane secondary fuel to the injection nozzle during initial starting of the engine. Secondly, it provides a lubricating film of the high viscosity secondary fuel on the outer surface of the plunger which tightly fits within the bore and thereby prevents fuel leakage toward the camshaft. The third function of the additional fuel pump is to form a seal which prevents excessive leakage of primary fuel toward the camshaft when the pump delivers primary fuel under high pressure to the injection nozzle after the engine has been started and warmed up.

An effective seal is formed by the high viscosity fuel in groove 100 to prevent leakage of primary fuel toward the camshaft due to the fact that there is no pressure differential between the helical groove and the annular groove since both of them are in communication with the mixing chamber 56. Since the primary fuel is under very high pressure when primary fuel is being delivered to the injection nozzle, it is important that there be no pressure differential between the helical groove and the annular groove. If a large pressure differential were to exist, leakage would occur no matter how high the viscosity of the secondary fluid is within groove 100. Simply providing a high viscosity secondary fuel within the annular groove without eliminating the pressure differential between the annular groove and the helical groove will not prevent leakage of primary fuel under a very high delivery pressure.

Control valves 124 and 134 may be operated so that only secondary fuel is pumped from the mixing chamber as when starting up the engine; or only primary fuel is pumped from the mixing chamber after the engine is warmed up; or primary and secondary fuel may be mixed only in the mixing chamber and pumped from the mixing chamber during certain phases of operation of the engine.

U.S. Pat. No. 2,968,298 discloses a fuel injection pump wherein an ignition-accelerator is added to the diesel engine fuel in a mixing chamber disposed outside the pump sleeve. The primary fuel is continuously admitted to the mixing chamber while a small amount of additive enters the mixing chamber intermittently. This patent does not provide a mixing chamber in the same location as in my invention, and there is no provision for supplying unmixed primary or secondary fuel to the mixing chamber or alternatively mixing primary and secondary fuels in the mixing chamber as discussed above.

Referring now to FIGS. 2–4 of the drawings, the check valve 72 is modified to provide a different construction and mode of operation as compared to the corresponding check valve shown in applicant's aforementioned patent. Check valve 72 is provided with cylindrical portion 80 which fits snugly into outlet port means 52 which is also of elongated construction. The lower end of the check valve has three spaced radially extending arms 82 the outer ends of which are flush with the outer surface of cylindrical portion and which serve to guide the check valve in its reciprocating movement while allowing fuel to flow past the check valve when the valve is lifted to the point where cylindrical portion 80 of the valve is positioned above the upper end of outlet means 52.

At the end of fuel injection by the full injection nozzle, the pressure within chamber 56 drops and check valve 72 is forced to close under the influence of spring 74. This will cause a suction force to be created in fuel line 78. The cylindrical portion 80 is sized to ensure that the suction force is sufficient to withdraw a small volume of hot gas from the combustion chamber of the cylinder into a heating space within the injector nozzle as more fully explained hereinafter. It is important to note that the amount of hot gas which enters the injector nozzle upon closing of check valve 72 is controlled by the volume of cylindrical portion 80 of the check valve.

A conventional cylinder 140 has a piston 142 reciprocably mounted therein, the usual connecting rod 144 being connected to the piston. Conventional inlet and outlet valves 150 and 152 are in communication with the combustion chamber 154 defined above the piston. A fuel injection means 156 in the form of an injection nozzle is supported in position to inject fuel into the combustion chamber thereby providing fuel under high pressure to the combustion chamber. The fuel injection means is connected to fuel line 78 to receive fuel under high pressure from the fuel injection pump. A conduit 160 is provided to carry off any leakage of fuel from the injection nozzle.

A fuel injection means comprises an injector nozzle including a second body portion 180 having a fuel channel 182 formed therein which is connected to the fuel line 78. As seen in FIGS. 5 and 6, the fuel channel is in communication with a heating space 184 formed in the lower portion of the body means. A main fuel orifice means 186 is in communication with the heating space and the combustion chamber. A conventional needle valve 190 is slidably mounted within a bore in the second body portion, and a conventional spring 192 is mounted within the second body portion and normally biases the needle valve downwardly into the closed position shown wherein the main fuel orifice is closed off from communication with the heating space.

A pilot fuel orifice means 200 is provided at the central portion of a generally hemispherical cutout 202 formed in the tip of the injector nozzle. The pilot fuel orifice means provides continuous communication between the heating space and combustion chamber. U.S. Pat. No. 2,627,254 discloses a fuel injection nozzle having a main fuel orifice and a pilot fuel orifice, but there are a number of important distinctions between the injector nozzle of the present invention and that disclosed in the patent. In the present invention, the main fuel orifice means produces a main flaring fuel spray which includes a flaring spray having a first cone angle (a) as seen in FIG. 5; and the pilot fuel orifice means produces a pilot flaring fuel spray which includes a second cone angle (b). In the invention, the first and second cone angles overlap one another as clearly seen in FIG. 5. This is in contrast with the construction shown in U.S. Pat. No. 2,627,254 wherein the cone angles of the main fuel spray and the pilot fuel spray are of a different nature and are separated from one another and there is no overlap therebetween.

In addition, the length to diameter ratio of the pilot fuel orifice in U.S. Pat. No. 2,627,254 is of the order of about 10:1 to 20:1. In contrast, the length to diameter ratio of the pilot fuel orifice in the present invention is preferably between about 0.5 and 3.0 in order to provide a flaring pilot fuel spray having the desired cone angle. FIG. 6 is an end view of the tip of the nozzle shown in FIG. 5.

It should be understood that the primary fuel orifice means of the invention may be of any conventional construction including more than one opening. In such a construction, a plurality of main fuel sprays each produce flaring sprays, with the cone angle of the pilot fuel spray overlapping the cone angle of at least one of the main fuel sprays.

METHOD OF OPERATION OF FIGS. 1–6

As mentioned previously, the fuel injection pump initially provides a secondary fuel to the fuel injection means to facilitate starting of the invention. After the engine has started up, a primary fuel is provided to the fuel injection means. When primary fuel is provided to the engine, the fuel injection means repeats the cycle of operation as set forth below.

At the end of one complete cycle of fuel injection when an expansion stroke begins, a suction force is created in the fuel supply line 78 between the injection pump and the injector nozzle due to the closing of check valve 72. A small amount of hot gas, in the form of bubbles, is withdrawn by the suction force from the combustion chamber through pilot fuel orifice 200 into heating space 184 within the nozzle. The temperature of the hot gas entering the nozzle is well above 3000 degrees Rankine. The temperature of the fuel in contact with the hot bubbles increases rapidly, partly due to mixing with the hot gas and partly due to chemical reaction between the fuel and the hot air within the bubbles.

During the following expansion stroke, when the cylinder pressure is below that within the nozzle, a small amount of the mixture within the heating space flows from the heating space into the combustion chamber. When the cylinder pressure becomes higher during the ensuing compression stroke, hot compressed air is forced into the heating space through the pilot orifice means to promote further rapid chemical reaction with the fuel in the heating space. This rapid chemical reaction leads to a further temperature increase of the pilot fuel.

When the pilot fuel is injected into the combustion chamber, the hot pilot fuel contacts the compressed air in the combustion chamber and is quickly ignited. At this point, the main fuel orifice means is still closed by needle valve 190. As the fuel pressure within the heating space is further increased by the injection fuel pump, the needle valve is lifted by the fuel pressure against the force of spring 192 to open main orifice means 186 for the main fuel injection. Thus a complete cycle of operation has been described from the completion of one fuel injection until the completion of a subsequent fuel injection. This cycle of operation is repeated during operation of the engine.

Figure 8:
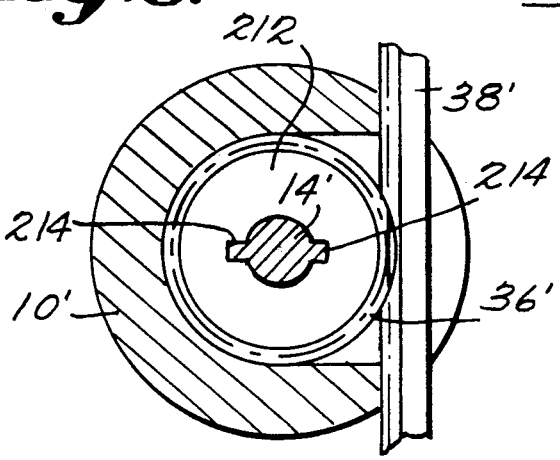
FIG. 8 is a sectional view taken along line 8—8 of FIG. 7.
Figure 7:
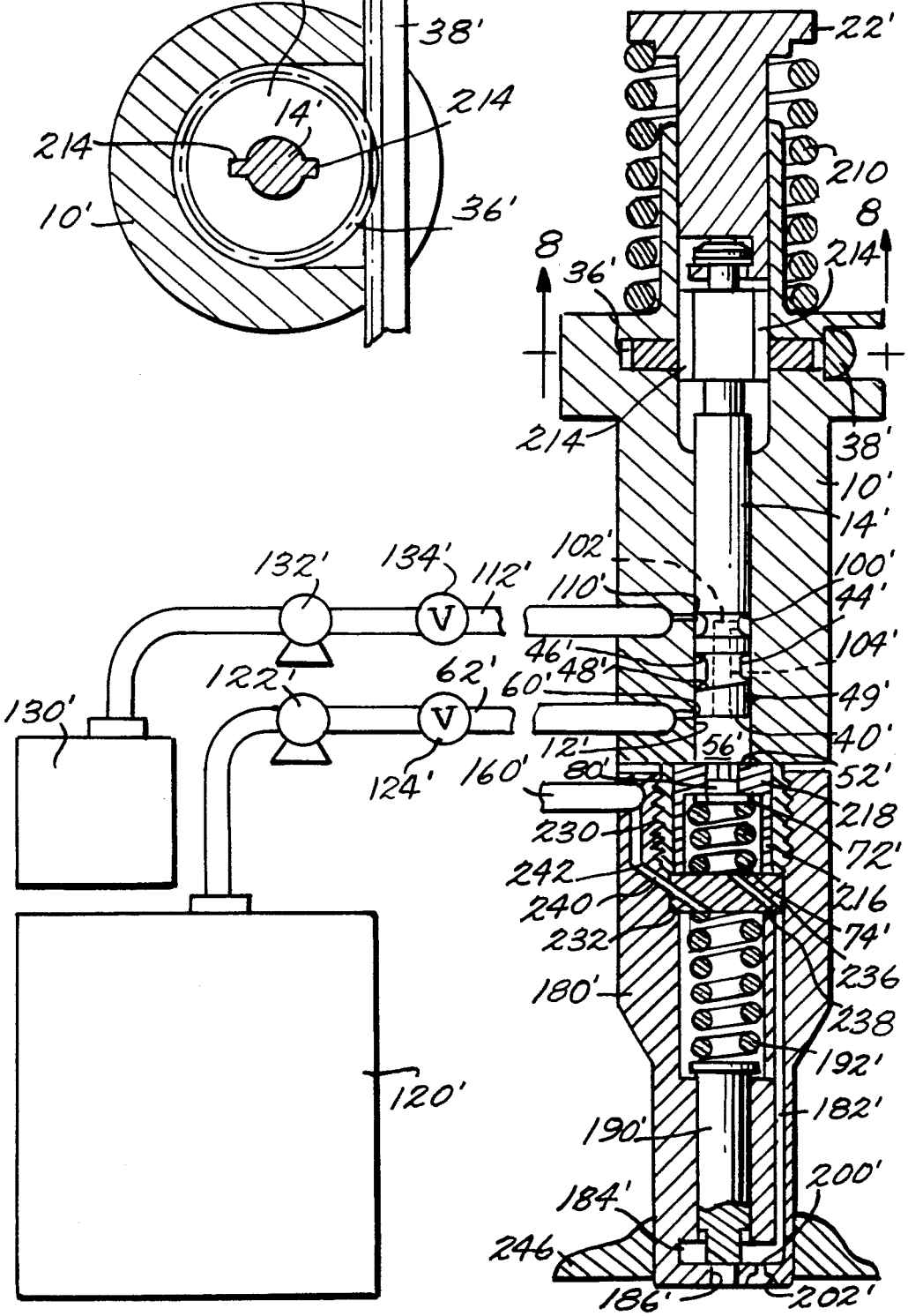
FIG. 7 is a somewhat schematic view, partly in section illustrating portions of a HPF-ignition internal combustion engine employing a unitary fuel injector including a dual fuel injection pump and a hot pilot fuel injection nozzle.

Referring now to FIG. 7 and 8, another form of the invention is shown wherein the dual fuel injection pump and hot pilot fuel injection nozzle are combined in a unitary structure such as shown for example in U.S. Pat. No. 3,737,100. Components of this form of the invention similar to those discussed in connection with FIGS. 1–6 have been given the same reference numerals primed. This unitary structure includes a first body portion 10' having a bore 12' formed therein. Elongated plunger means 14' is mounted for reciprocation and rotation within the bore. The outer surface of the plunger has a tight fit within the bore 12' in the first body portion.

A cam means (not shown) similar to cam means 20 previously described engages a follower portion 22' connected to the upper end of the plunger means to cause reciprocation of the plunger means within the bore. A spring 210 biases the plunger in an upward direction to maintain the follower portion 22' in engagement with the cam means at all times. As seen in FIG. 8, gear 212 has circumferentially extending teeth 36' thereon which mesh with a rack 38' so that longitudinal movement of the rack into or out of the plane of the paper will cause rotation of the sleeve. Rack member is operated in a known manner so as to vary the effective stroke of the plunger means of the pump. In a multiple cylinder engine, a rack will be provided for each cylinder and all racks are linked together mechanically electrically or hydraulically so as to operate in predetermined order. As seen most clearly in FIG. 8, plunger means 14' is provided with a pair of radially projecting ribs or splines 214 which are slidably received in complementary longitudinal slots formed in gear 212 so that the plunger means 14' can be rotated by movement of rack 38' while the plunger means reciprocates in a vertical direction with respect to gear 212.

The plunger means includes a lower end surface 40' and a helical groove 44', formed around the outer periphery of the plunger means, is spaced from the end surface. This helical groove is defined between an upper edge 46' which extends substantially circumferentially around the plunger means and a lower edge 48' which defines a portion of a helix. A longitudinally extending groove 49' provides communication between the helical groove and the end surface 40'.

The lower end of bore 12' in the first body portion is closed off by a generally cup-shaped member 216 including an end wall 218 having an outlet port means 52' formed therethrough. A mixing chamber 56' is defined within the bore in the first body portion and between the end wall 218 and the lower end surface 40' of the plunger means. An inlet port means 60' in the first body portion is adapted to be in communication with chamber 56' and is connected to a conduit 62'.

FIG. 7 illustrates the plunger means in its upper limit of travel wherein inlet port means 60' is in communication with chamber 56'. When the associated cam means rotates, plunger means 14' initially moves downward to shut off communication between inlet port means 60' and chamber 56'. As the plunger means moves further in a downward direction, the pressure of the fuel within chamber 56' builds up. It is noted that fluid from the mixing chamber can pass through groove 49' into helical groove 44'. When helical groove 44' comes into communication with inlet port means 60' as the plunger means moves downwardly, the fuel under high pressure within the helical groove can pass back through inlet port means 60' and into conduit 62'.

As the plunger means rotates, different portions of the lower edge of the helical groove will be aligned with the inlet port means 60' so that the plunger means will move different distances in an axial direction before the helical groove comes into communication with the inlet port means, thereby varying the effective stroke of the plunger means. It is apparent that once the helical groove is in communication with the inlet port means, the fuel within chamber 56' can then flow back into conduit 62'.

A one-way check valve means includes a valve member 72' identical to the valve member 72 previously described and which is slidably disposed within end wall 218 of member 216. Valve member 72' is biased into closed position by spring 74' also disposed within member 216. When the plunger means moves downwardly, the high pressure generated within chamber 56' causes the valve member to move downwardly against the force of the spring and high pressure fuel flows past the valve member.

The plunger means has an annular groove or recess 100' extending therearound. Passage means formed within the plunger means provides communication between the annular groove and the chamber 56', and includes a radial portion 102' which joins with a longitudinal portion 104'. The passage means includes opposite ends, the outer end of the radial portion 102' opening into the annular groove, and the lower end of longitudinal portion 104' opening into chamber 56' at the lower surface 40' of the plunger means. The first body portion is provided with a second inlet port means 110' which is in communication with conduit 112'.

Conduit 62' is connected with a source of primary fuel such as alcohol in the form of a conventional fuel tank 120'. A conventional low pressure fuel pump 122' is connected in conduit 62' for pumping fuel from the primary fuel tank into the high pressure fuel injection pump. A conventional control valve 124' is connected in conduit 62' for controlling the flow of primary fuel to the fuel injection pump.

A conduit 112' is connected to inlet port means 110' and is also connected to a source of secondary fuel such as diesel fuel in the form of a conventional fuel tank 130' which has a much smaller capacity than tank 120'. A conventional low pressure fuel pump 132' is connected in conduit 112' for pumping fuel from the secondary fuel tank into the high pressure fuel injection pump. A conventional control valve 134' is connected in conduit 112 for controlling the flow of secondary fuel to the fuel injection pump.

The fuel injection means of this form of the invention includes a second body portion 180' having a fuel channel 182' therein which receives the high pressure fuel from the fuel injection pump. A leakage means includes a conduit 160' for carrying off any leakage of fuel around the needle valve 190' which is biased into closed position by a spring 192'.

The lower end of first body portion 10' is provided with a cylindrical extension 230 have threads formed on the outer surface thereof. The second body portion has an enlarged upper bore 232 formed therein the lower unthreaded end of which receives a divider plate 236. The upper end of bore 232 has threads formed on the inner surface thereof which engage threads formed on the outer surface of extension 230 for securing the first and second body portions to one another to provide a unitary structure. It will be noted that cup-shaped member 218 is disposed within extension 230 and rests upon the upper surface of a divider plate 236 disposed within the lower unthreaded portion of bore 232.

Divider plate 236 has a first passage 238 formed therethrough providing communication between the valve means 72' and passage 182' which in turn is in communication with the heating space 184' at the lower end of second body portion 180'. When the plunger means moves downwardly, the high pressure generated within chamber 56' causes the valve means to open, and high pressure fuel flows past the valve means, through the cup shaped member 218, passage 238 and passage 182' to the heating space 184'. The divider plate also has a second passage 240 formed therethrough which provides communication between the space above the needle valve 190' and a passage 242 formed in the second body portion 180' and which is in communication with leakage conduit 160'.

The main fuel orifice means 186' and pilot fuel orifice means 200' are identical with those previously described. Here again, the amount of hot gas drawn from the combustion chamber into the heating space 184' is controlled by the volume of the cylindrical section 80' of the check valve 72'. The difference in time between the hot pilot fuel injection and the main fuel injection is closely controlled by the relative spring constant of springs 74' and 192'. The amount of pilot fuel injection relative to the main fuel injection is determined by the area of the pilot fuel injection orifice means 200. A cylinder similar to cylinder 140 previously described includes a cylinder head 246, and the unitary fuel injector is mounted in the usual manner. The method of operation of an engine employing the embodiment shown in FIGS. 7 and 8 is the same as that of FIGS. 1–6.

Referring now to FIGS. 9–14, a further form of the invention is illustrated. As seen in FIG. 9, similar parts to those previously described have been given the same reference numerals double primed. It should be understood that the cut-off wavy line at the top of this figure indicates that the portion of the device above this line has been broken away, and the portion above the cut-off wavy line is identical in construction to the corresponding upper portion of the structure shown in FIG. 7. In fact, the only difference of the construction shown in FIG. 9 from than shown in FIG. 7 lies in the construction of the lowermost part of the second body portion 180'' and the needle valve 190''.

As seen most clearly in FIG. 12, the lowermost part of body portion 180'' is modified so as to be provided with an extension means 250 which may be either integral with the body portion or may comprise a separate member suitably secured to the body portion. The extension means is adapted to extend into a combustion chamber of the associated cylinder as shown in FIG. 9. A heating space 252 is disposed within the extension means for retaining a quantity of fuel during operation of invention so that the quantity of fuel is heated by conduction from the combustion chamber through the extension means. This heated quantity of fuel becomes the hot pilot fuel which is subsequently injected into the combustion chamber as hereinafter explained.

Hot pilot fuel orifice means is provided in the form of a plurality of passages 254 which may be of suitable number and location and which provide communication between the heating space and the associated combustion chamber at all times. Main fuel orifice means is provided in the form of a plurality of passages 256 which may also be of suitable number and location, passages 256 being of greater cross-section than passages 254. Passages 256 provide communication between the heating space and the associated combustion chamber during certain periods of operation of the device.

As seen in FIGS. 10 and 11, the lower end of needle valve 190'' is provided with an annular shoulder 260, and a generally frustoconical outer surface 262 extends downwardly from the inner periphery of this shoulder. A passage 264 has opposite ends which open through the lower part of outer surface 262. A passage 266 is formed in the lower cylindrical portion 268 of the needle valve and the upper end of passage 266 intersects passage 264.

Figure 14:
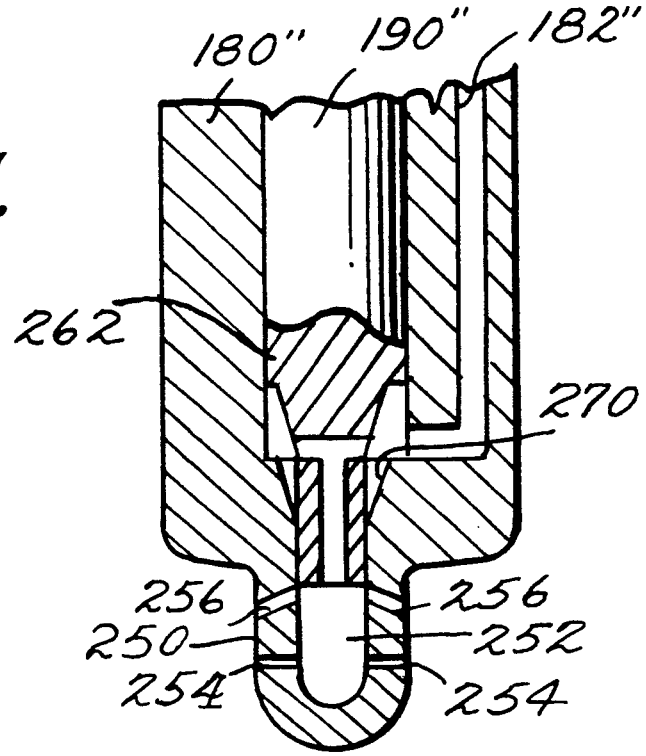
FIG. 14 is a view similar to FIG. 13 showing the needle valve in a lifted position after further movement thereof.

As seen in FIGS. 13 and 14, the lower end of body portion 180'' is provided with a cooperating surface 270 which is adapted to engage and form a seal with the surface 262 on the needle valve when the needle valve is in its closed position as shown in FIG. 9. Surface 270 is also of generally frusto-conical configuration and is complementary to surface 262. The lower cylindrical portion 268 of the needle valve is slidably and snugly received within a bore 272 formed within the extension means 250.

When the needle valve is in closed position as shown in FIG. 9, surfaces 262 and 270 engage one another and form a seal which prevents communication between the source of high pressure and the heating space 252. When the needle valve initially moves into the position shown in FIG. 13, the surfaces 262 and 270 move away from one another and communication is established between the heating space 252 and passage 182'' by means of passages 264 and 266 in the needle valve. This enables fuel under high pressure to flow into the heating space and force the quantity of heated fuel in the heating space to be injected into the combustion chamber as hot pilot fuel to cause ignition of the fuel-air mixture in the combustion chamber.

Upon further movement of the needle valve in an upward direction into the position shown in FIG. 14, the main fuel orifice passages 256 are uncovered and the main fuel spray is injected into the combustion chamber. As the needle valve moves back into the position shown in FIG. 13, the main fuel orifice means are blocked. Further movement of the needle valve into the position shown in FIG. 9 interrupts communication between the source of high pressure fuel and the heating space, trapping a quantity of fuel within the heating space to be subsequently heated by conduction. This heated quantity of fuel becomes hot pilot fuel sprayed into the combustion chamber during the next cycle of operation. Since pilot fuel is preheated within the extension means by conduction without drawing hot gas from the combustion chamber, the cylindrical portion 80 or 80' of the valve means of the previously described embodiments is eliminated as clearly seen in FIG. 9.

METHOD OF OPERATION OF FIGS. 9–12

The fuel injection pump initially provides a secondary fuel to the fuel injection means to facilitate starting of the invention. After the engine has started up, a primary fuel is provided to the fuel injection means. When primary fuel is provided to the engine, the fuel injection means repeats the cycle of operation as set forth below.

Main fuel is injected into the combustion chamber of a cylinder of the engine in the position shown in FIG. 14. When the device then moves into the position shown in FIG. 9, fuel injection is ended and a quantity of fuel is retained in the heating space within the extension means which extends into the combustion chamber. The retained quantity of fuel is heated by conduction of heat from the combustion chamber through the extension means to the retained fuel.

When the device moves into the position shown in FIG. 13, hot pilot fuel is injected from the heating space into the combustion chamber near the end of the compression stroke of the piston of the engine to mix with the compressed air in the combustion chamber and ignite the mixture by autoignition. When the device then moves into the position shown in FIG. 14, the combustion process is continued by injecting main fuel after the top dead center position into the combustion chamber through the main fuel orifice means. Thus a complete cycle of operation has been described from the completion of one main fuel injection until the completion of a subsequent fuel injection. This cycle of operation is repeated during operation of the engine.

To demonstrate the advantage of a HPF-ignition engine over a spark-ignition gasoline engine, theoretical computations have been carried out on two air cycles, one for a constant volume cycle for a gasoline engine and the other for a constant pressure cycle arbitrarily chosen for a HPF-ignition engine with compression ratios of 8.5 and 20.0 respectively. Computations are made on the following assumptions: $P_1=14.7$ psi; $T_1=600°$ R.; $V_1=15.11$ ft$^3$; $Q=1280$ BTU/lb air Computed results are listed in the Table below:

| | $P_2$ | $V_2$ | $T_2$ | $P_3$ | $V_3$ | $T_3$ | $P_4$ | $T_4$ | eff. |
|---|---|---|---|---|---|---|---|---|---|
| A | 294 | 1.778 | 1412 | 1853 | 1.778 | 8897 | 92 | 3780 | 0.575 |
| B | 974 | 0.756 | 1988 | 974 | 2.78 | 7321 | 91 | 3719 | 0.582 |
| a | 974 | 0.756 | 1988 | 974 | 2.28 | 5988 | 69 | 2810 | 0.605 |
| b | 974 | 0.756 | 1988 | 974 | 1.77 | 4655 | 48 | 843 | 0.632 |

-continued

| | $P_2$ | $V_2$ | $T_2$ | $P_3$ | $V_3$ | $T_3$ | $P_4$ | $T_4$ | eff. |
|---|---|---|---|---|---|---|---|---|---|
| c | 974 | 0.756 | 1988 | 974 | 1.26 | 3321 | 30 | 736 | 0.662 |

Figure 15:
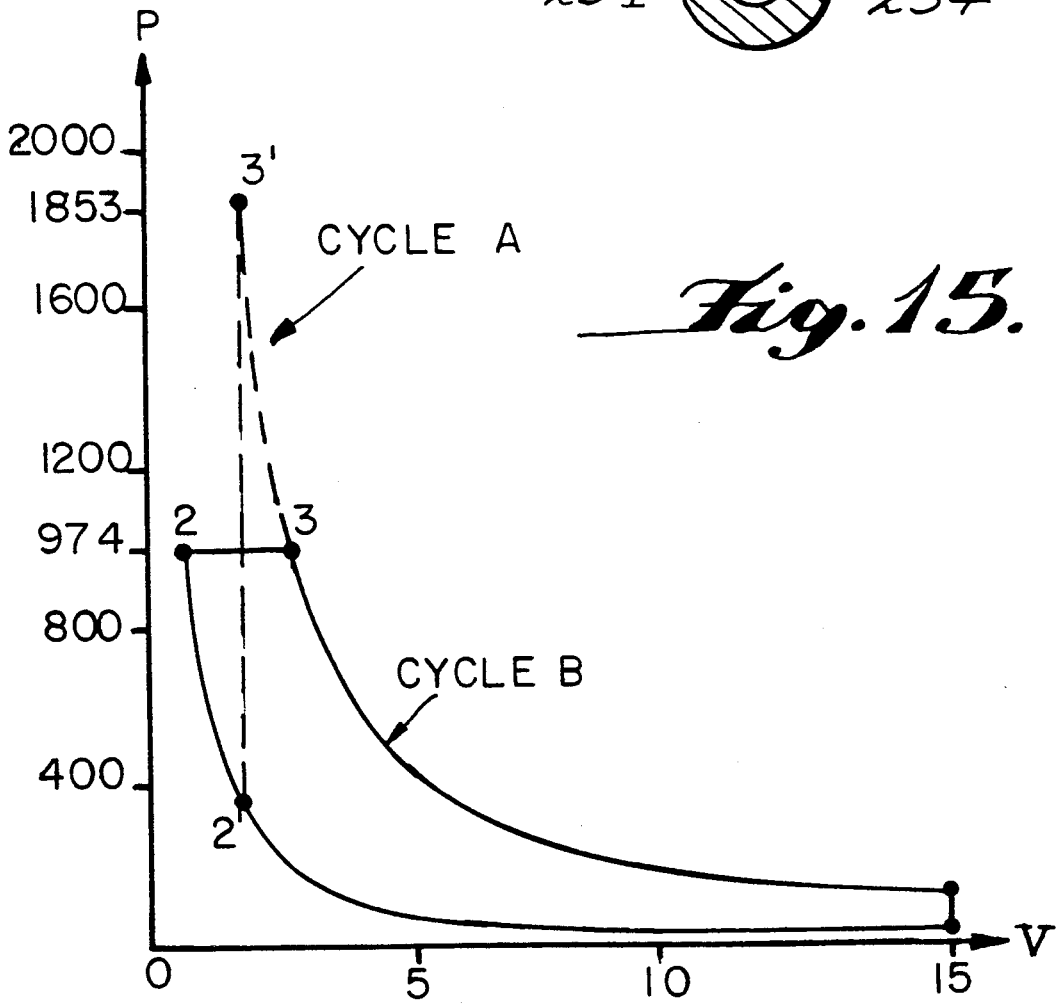
FIG. 15 is a graph showing the comparison of volume and pressure of a cycle of operation of a spark-ignition gasoline engine and a cycle of operation of an HPF-ignition engine of the invention.

In the above table, row A is a constant volume cycle, row B is a constant pressure cycle, and rows a, b and c are constant pressure cycles with $\frac{3}{4}$, $\frac{1}{2}$ and $\frac{1}{4}$ partial load conditions respectively The results of rows A and B are plotted in FIG. 15 for comparison. In cycle B including points 1, 2, 3, 4 defining a constant pressure cycle, the main fuel injection starts after top dead center covering a duration of about 40 degrees of crank angle between points 2 and 3 as indicated by the value of $V_3$. Cycle A includes points 1, 2', 3' 4 defining a constant volume cycle. By comparing row B with row A in the Table and the P-V diagrams in FIG. 15, it can be seen that at full load, the HPF-ignition engine has only one-half of the maximum firing pressure and 1576° R. less in maximum firing temperature. It has almost the same efficiency at a full load, but much higher efficiencies at partial loads.

With much lower maximum cycle pressure and temperature, the mechanical efficiency of the HPF-ignition engine is also higher. Having a much lower maximum pressure with no adverse rate of pressure rise, the HPF-ignition engine will operate smoother and quieter than a gasoline engine. With a high compression ratio, a HPF-ignition engine can be started in cold weather on commercial diesel oil. After that it can operate on low cetane fuels such as straight run petroleum products or other available alternative fuels. The compression ratio of a HPF-ignition engine can be chosen high enough, as long as the compression pressure is lower than an allowable limit, to eliminate the ignition delay and to minimize the formation of CO and HC.

Using a dual fuel injection pump of the invention which can deliver a liquid fuel under a high pressure regardless of its viscosity and a hot pilot fuel ignition to eliminate the ignition delay, it is now possible to achieve a lightweight efficient multi-fuel HPF-ignition engine with a better engine emission control.

In recent years, a great deal of effort has been made to seek better fuels for emission control. It is far more fruitful to seek a better engine rather than seeking better fuels. An existing diesel engine can be converted to a multi-fuel HPF-ignition engine by replacing its fuel injection system with that of a HPF-ignition engine. A gasoline engine can also be converted to a more efficient multi-fuel HPF-ignition engine by modifying its cylinder head to increase the compression ratio and to accommodate the new fuel system to replace its carburetor fuel system and electrical system including a spark plug with the novel fuel injection pump and fuel injection nozzle of the present invention. These engine conversions can be easily accomplished to greatly reduce the engine emissions.

A compression ratio of a HPF-ignition engine can be chosen high enough to start the engine in cold weather with a commercial diesel oil as a secondary fuel. Because of the hot pilot fuel ignition, the ignition delay of the main fuel injection of a HPF-ignition engine is substantially eliminated. Without the ignition delay, the firing pressure variation during combustion can be closely controlled by the rate of the main fuel injection. Accordingly, a high compression ratio can be chosen without the concern of a high firing pressure. This is important since it is possible to achieve the best compromise among engine efficiency, engine weight and emission control by an appropriate choice of fuel injection rate.

The formation of $NO_x$ and particulates can be minimized by choosing an appropriate firing pressure distribution curve while the formation of CO and HC can be controlled by a high compression ratio to provide a very high temperature without the concern of overstressing the engine structure.

What is claimed is:

1. A hot pilot fuel ignited internal combustion engine comprising a first source of primary fuel, a second source of secondary fuel, injection pump means including a first body portion having a bore therein, plunger means movably mounted within said bore, said plunger means having an end portion defining with a portion of said bore a mixing chamber in the interior of said bore, first supply means including first inlet port means opening into the interior of said bore for supplying primary fuel from said first source to said mixing chamber, second supply means including second inlet port means opening into the interior of said bore for supplying secondary fuel from said second source to said mixing chamber so that said primary and secondary fuels can be mixed in said mixing chamber to provide a mixture of the primary and secondary fuels, said second supply means including means spaced from said said end portion in a direction away from said mixing chamber for providing a seal between said bore and said plunger means to prevent leakage of primary fuel past the seal, valve means permitting flow of fuel from said mixing chamber but substantially preventing flow of fuel back into said mixing chamber, a cylinder having a piston reciprocably mounted therein and defining with said cylinder a combustion chamber, fuel injection means for injecting fuel into said combustion chamber, said fuel injection means including a second body portion including a heating space for receiving and heating fuel, means providing communication between said valve means and said heating space so that said injection pump means provides fuel under high pressure to said heating space, said second body portion including a main fuel orifice means which provides communication between said heating space and said combustion chamber to inject into said combustion chamber a main fuel spray, needle valve means movably supported by said second body portion, resilient means biasing said needle valve means toward a closed position preventing communication between said heating space and said main fuel orifice means, said second body portion including pilot fuel orifice means in communication with said heating space and said combustion chamber to inject into said combustion chamber a hot pilot fuel spray to produce autoignition.

2. An engine as defined in claim 1 wherein said pilot fuel orifice means is in communication at all times with said heating space and said combustion chamber so that hot gas can be drawn from the combustion chamber into said space to mix with the fuel in the space to greatly raise the temperature of the fuel in the space.

3. An engine as defined in claim 2 wherein said main fuel spray includes a flaring spray having a first cone angle, said pilot fuel spray including a flaring spray having a second cone angle, said first and second cone angles overlapping one another within said combustion chamber.

4. An engine as defined in claim 2 wherein said main fuel orifice means and said pilot fuel orifice means are laterally offset from one another.

5. An engine as defined in claim 2 wherein the length to diameter ratio of said pilot fuel orifice means is between about 0.5 and 3.0.

6. An engine as defined in claim 2 wherein said main fuel orifice means and said pilot fuel orifice means are laterally offset from one another, said main fuel spray and said pilot fuel spray overlapping one another within said combustion chamber, and the length to diameter ratio of said pilot fuel orifice means is between about 0.5 and 3.0.

7. An engine as defined in claim 2 including control means for controlling the amounts of primary and secondary fuels supplied to said mixing chamber dependent on conditions within said combustion chamber.

8. An engine as defined in claim 2 wherein said plunger means is mounted for reciprocation and rotation within said bore, said second supply means including an annular groove formed on said plunger means, passage means providing communication between said annular groove and said mixing chamber, said second inlet means adapted to be in communication with said annular groove, secondary fuel disposed in said annular groove providing a seal between said bore and said plunger means.

9. An engine as defined in claim 8 wherein said passage means is formed within said plunger means and extends between said annular groove and said end portion of the plunger means.

10. An engine as defined in claim 2 wherein said plunger means is mounted for reciprocation and rotation within said bore, said plunger means having a helical groove formed thereon and being spaced from said end portion, means providing communication between said helical groove and said mixing chamber, means for reciprocating and rotating said plunger means within said bore, said second supply means including an annular groove formed on said plunger means, said annular groove being spaced from said helical groove, said helical groove being disposed between said annular groove and said mixing chamber, passage means providing communication between said annular groove and said mixing chamber, said second inlet port means adapted to be in communication with said annular groove, secondary fuel disposed in said annular groove and being at the same pressure as the fuel pressure in said helical groove thereby providing a seal between said bore and said plunger means to prevent leakage of primary fuel from said helical groove past said seal.

11. An engine as defined in claim 1 wherein said first and second body portions are attached to one another to provide a unitary construction.

12. An engine as defined in claim 11 including a divider means supported by said second body portion, said divider means having first passage means therein providing communication between said valve means and said heating space, leakage means for carrying off leakage around said needle valve means, said divider means having second passage means therein providing communication between said needle valve means and said leakage means.

13. An engine as defined in claim 1 including an extension means which extends from said second body portion into the combustion chamber, said heating space being disposed within said extension means so that fuel within said space is heated by conduction of heat from said combustion chamber through said extension means fuel within the space.

14. An engine as defined in claim 13 wherein when said needle valve means is constructed and arranged so that when it is in closed position it also prevents communication between said heating space and said valve means.

15. An engine as defined in claim 14 wherein said needle valve means is constructed and arranged so that when it is initially opened, communication is provided between said pilot fuel orifice means and said valve means, and upon further opening movement communication is also provided between said main fuel orifice means and said valve means.

16. An engine as defined in claim 13 wherein said extension means has a bore formed therein, said needle valve means having a reduced end portion slidably received within said bore in said extension means, said reduced end portion having passage means therein providing communication between said heating space and the outer surface of said needle valve means at a position spaced from said heating space.

17. An engine as defined in claim 16 wherein said outer surface is of substantially frusto-conical configuration, said second body portion having a cooperating surface formed thereon adapted to engage said outer surface, said cooperating surface also being of substantially frusto-conical configuration.

18. A hot pilot fuel ignited internal combustion engine comprising, a first source of primary fuel, a second source of secondary fuel, injection pump means including a first body portion having a bore therein, plunger means movably mounted within said bore, said plunger means having an end portion defining with a portion of said bore a mixing chamber in the interior of said bore, first supply means including first inlet port means opening into the interior of said bore for supplying primary fuel from said first source to said mixing chamber, second supply means including second inlet port means opening into the interior of said bore for supplying secondary fuel from said second source to said mixing chamber so that said primary and secondary fuels can be mixed in said mixing chamber to provide a mixture of primary and secondary fuels, valve means permitting flow of fuel from said mixing chamber but substantially preventing flow of fuel back into said mixing chamber, a cylinder having a piston reciprocably mounted therein and defining with said cylinder a combustion chamber, fuel injection means for injecting fuel into said combustion chamber, said fuel injection means including a heating space for receiving and heating fuel, means providing communication between said valve means and said heating space so that said injection pump means provides fuel under high pressure to said heating space, said fuel injection means including a main fuel orifice means which is in communication with said heating space and said combustion chamber to inject a main fuel spray into said combustion chamber, said fuel injection means including movable needle valve means, resilient means biasing said needle valve means toward a closed position preventing communication between said heating space and said main fuel orifice, said fuel injection means including a pilot fuel orifice means which is in communication with said heating space and said combustion chamber and adapted to inject a pilot fuel spray into said combustion chamber to produce autoignition.

19. An engine as defined in claim 18 wherein s id pilot fuel orifice means is in communication with said heating space at all times.

20. An engine as defined in claim 18 wherein said main fuel spray includes a flaring spray having a first cone angle, said pilot fuel spray including a flaring spray having a second cone angle, said first and second cone angles overlapping one another within said combustion chamber.

21. A fuel injection nozzle for a hot pilot fuel ignited internal combustion engine including a heating space therein and having a fuel channel in communication with said heating space, said nozzle means having a main fuel orifice means therein which is in communication with said heating space to discharge main fuel including a flaring spray having a first cone angle into a combustion chamber, needle valve means movably supported by said nozzle means, resilient means biasing said needle valve means toward a closed position preventing communication between said heating space and said main fuel orifice means, said nozzle means having a pilot fuel orifice means in communication with said heating space to discharge pilot fuel including a flaring spray having a second cone angle into a combustion chamber, said first and second cone angles overlapping one another exteriorly of the fuel injection nozzle.

22. A fuel injection nozzle as defined in claim 20 wherein said pilot fuel orifice has a length to diameter ratio between about 0.5 and 3.0.

23. A fuel injection nozzle for a hot pilot fuel ignited internal combustion engine including extension means for extending into a combustion chamber, said extension means having a heating space therein, said extension means including main fuel orifice means for providing communication between said heating space and a combustion chamber to inject into a combustion chamber a main fuel spray, said extension means including pilot fuel orifice means for providing communication between said heating space and a combustion chamber to inject into a combustion chamber a hot pilot fuel spray, said nozzle including passage means adapted to be connected with a source of fuel under high pressure, needle valve means movably supported by said nozzle, resilient means biasing said needle valve means toward a closed position preventing communication between said heating space and said main fuel orifice means and also preventing communication between said heating space and said passage means.

24. An engine as defined in claim 23 wherein said extension means has a bore formed therein, said needle valve means having a reduced end portion slidably received within said bore in said extension means, said reduced end portion having passage means therein providing communication between said heating space and the outer surface of said needle valve means at a position spaced from said heating space.

25. An engine as defined in claim 24 wherein said outer surface is of substantially frusto-conical configuration, said second body portion having a cooperating surface formed thereon adapted to engage said outer surface, said cooperating surface also being of substantially frusto-conical configuration.

26. The method of operating a hot pilot fuel ignited internal combustion engine comprising injecting main fuel into a combustion chamber of a cylinder of the engine from a fuel injection means in communication with the combustion chamber, drawing hot gas from the combustion chamber into a heating space in the fuel injection means at the end of said fuel injection, mixing fuel in the heating space with the hot gas in the heating space to produce a mixture and to greatly raise the temperature of the fuel in the heating space, discharging a portion of said mixture from the heating space during the expansion stroke of the piston, forcing hot air from the combustion chamber into the heating space during the compression stroke of the piston, injecting a hot pilot fuel into the combustion chamber near the end of the compression stroke of the piston to mix with the compressed air in the combustion chamber and igniting the mixture by autoignition, and then continuing the combustion process by injecting main fuel after the top dead center position into the combustion chamber from the fuel injection means, and repeating the cycle of steps defined above.

27. The method as defined in claim 26 including the steps of supplying a secondary fuel having high ignition qualities to said fuel injection means when the engine is initially started up, and then supplying a primary fuel to the fuel injection means during further operation of the engine.

28. The method of operating a hot pilot fuel ignited internal combustion engine comprising injecting main fuel into a combustion chamber of a cylinder of the engine from a fuel injection means in communication with the combustion chamber, at the end of fuel injection retaining a quantity of fuel in a heating space within a portion of the fuel injection means extending into the combustion chamber, heating the retained quantity of fuel within said heating space by conduction of heat from the combustion chamber through said portion of the fuel injection means to the retained fuel, injecting hot pilot fuel from the heating space into the combustion chamber near the end of the compression stroke of the piston to mix with the compressed air in the combustion chamber and igniting the mixture by autoignition, and then continuing the combustion process by injecting main fuel after the top dead center position into the combustion chamber from the fuel injection means, and repeating the cycle of steps defined above.

29. The method as defined in claim 28 including the steps of supplying a secondary fuel having high ignition qualities to said fuel injection means when the engine is initially started up, and then supplying a primary fuel to the fuel injection means during further operation of the engine.

* * * * *